US011566456B2

(12) United States Patent
Naylor

(10) Patent No.: US 11,566,456 B2
(45) Date of Patent: Jan. 31, 2023

(54) THROW LOCK ASSEMBLY AND BOLT KEEPER ASSEMBLY

(71) Applicant: BJA Trading Ltd, Buckinghamshire (GB)

(72) Inventor: Mark Anthony Naylor, Cheshire (GB)

(73) Assignee: BJA Trading Ltd

( * ) Notice: Subject to any disclaimer, the term of this patent is extended or adjusted under 35 U.S.C. 154(b) by 786 days.

(21) Appl. No.: 16/482,681

(22) PCT Filed: Jan. 29, 2018

(86) PCT No.: PCT/EP2018/052152
§ 371 (c)(1),
(2) Date: Jul. 31, 2019

(87) PCT Pub. No.: WO2018/141693
PCT Pub. Date: Aug. 9, 2018

(65) Prior Publication Data

US 2020/0002982 A1 Jan. 2, 2020

(30) Foreign Application Priority Data

Jan. 31, 2017 (GB) ..... 1701551

(51) Int. Cl.
*E05C 1/02* (2006.01)
*E05B 15/02* (2006.01)
*E05B 65/00* (2006.01)

(52) U.S. Cl.
CPC ..... *E05C 1/02* (2013.01); *E05B 15/0225* (2013.01); *E05B 65/0007* (2013.01); *E05B 2015/023* (2013.01)

(58) Field of Classification Search
CPC .... E05C 1/02; E05B 15/0225; E05B 65/0007; E05B 2015/023
See application file for complete search history.

(56) References Cited

U.S. PATENT DOCUMENTS 381,792 A * 4/1888 Jones ..... E05C 19/02 292/74
1,194,636 A * 8/1916 Joy ..... E05B 17/08 292/DIG. 58

(Continued)

FOREIGN PATENT DOCUMENTS

AU 2002100150 A4 5/2002
CA 2133050 A1 3/1996

(Continued)

OTHER PUBLICATIONS

Search Report dated May 24, 2017 in connection with United Kingdom Patent Application No. GB1701551.2, 2 pages.

(Continued)

*Primary Examiner* — Mark A Williams

(57) ABSTRACT

A lock assembly comprising a throw bolt, a bolt holder and a bolt keeper. The bolt keeper comprises a buffer and a biasing mechanism, configured such that when the lock assembly is arranged as in use, and the throw bolt is in the locking position, the buffer will space the throw bolt apart from a surface to which the bolt keeper is attached; and the biasing mechanism will bear on the bolt and bias it against the buffer.

11 Claims, 6 Drawing Sheets

(56) References Cited

U.S. PATENT DOCUMENTS

| | | | | | |
|---|---|---|---|---|---|
| 1,265,351 | A * | 5/1918 | Menier | E05B 17/007 | 292/DIG. 58 |
| 1,663,300 | A * | 3/1928 | Halper | E05B 63/244 | 292/341.17 |
| 2,099,456 | A * | 11/1937 | Sweet | E05B 63/244 | 292/DIG. 40 |
| 2,290,727 | A | 7/1942 | Best | | |
| 2,581,606 | A * | 1/1952 | Seaman | E05B 15/10 | 292/74 |
| 2,873,989 | A | 2/1959 | Stone et al. | | |
| 3,586,361 | A * | 6/1971 | Ohno | E05C 19/163 | 292/153 |
| 4,049,304 | A * | 9/1977 | Imhoff | E05C 7/06 | 292/333 |
| 4,181,338 | A * | 1/1980 | Sterling | E05B 15/022 | 292/341.17 |
| 4,552,392 | A | 11/1985 | Morello | | |
| 4,893,854 | A * | 1/1990 | Dietrich | E05B 15/022 | 292/341.12 |
| 4,893,855 | A * | 1/1990 | Itakura | E05B 63/244 | 292/341.17 |
| 5,152,558 | A | 10/1992 | Smith et al. | | |
| 5,193,867 | A * | 3/1993 | Husted | E05C 19/182 | 292/288 |
| 5,280,973 | A | 1/1994 | Culling | | |
| 5,551,264 | A | 9/1996 | Fann et al. | | |
| 5,704,666 | A * | 1/1998 | Guillemette | E05B 63/242 | 292/346 |
| 5,757,269 | A * | 5/1998 | Roth | E05B 45/083 | 292/DIG. 60 |
| 5,825,288 | A * | 10/1998 | Wojdan | E05B 45/083 | 340/542 |
| 6,089,627 | A * | 7/2000 | Pearson | E05B 15/0205 | 292/DIG. 60 |
| 7,267,379 | B2 * | 9/2007 | Rusiana | E05C 7/06 | 292/DIG. 44 |
| 7,410,196 | B2 * | 8/2008 | Stein | E05B 47/0047 | 292/341.15 |
| 9,255,425 | B2 * | 2/2016 | Wittke | E05B 47/0047 | |
| 9,476,227 | B2 * | 10/2016 | Scheffler | E05B 63/248 | |
| 2005/0160775 | A1 | 7/2005 | Evans | | |
| 2007/0052245 | A1 | 3/2007 | Bodily et al. | | |
| 2007/0200356 | A1 | 8/2007 | Thornton et al. | | |
| 2015/0337574 | A1 | 11/2015 | Speckamp | | |

FOREIGN PATENT DOCUMENTS

| | | | |
|---|---|---|---|
| DE | 22 63 702 | A1 | 7/1974 |
| DE | 102 16 718 | A1 | 10/2003 |
| EP | 1 113 127 | A1 | 7/2001 |
| FR | 404 777 | A | 12/1909 |
| FR | 574792 | A | 7/1924 |
| FR | 2191 587 | A5 | 2/1974 |
| GB | 1135192 | A | 12/1968 |
| JP | 2005016093 | A | 1/2005 |
| JP | 2010024767 | A | 2/2010 |
| WO | 2009/125436 | A1 | 10/2009 |

OTHER PUBLICATIONS

Combined Search and Examination Report under Sections 17 & 18(3) dated May 25, 2017 in connection with United Kingdom Patent Application No. GB1701551.2, 2 pages.

International Search Report dated May 18, 2018 in connection with International Patent Application No. PCT/EP2018/052152, 3 pages.

Written Opinion of the International Searching Authority dated May 18, 2018 in connection with International Patent Application No. PCT/EP2018/052152, 7 pages.

United Kingdom Intellectual Property Office, "Examination Report under Section 18(3)", dated Mar. 1, 2021, in connection with United Kingdom Patent Application No. GB1902814.1, 4 pages.

Combined Search and Examination Report under Section 17 & 18(3) dated Jun. 2, 2017 in connection with United Kingdom Patent Application No. GB 1701547.0, 6 pages.

Examination Report under Section 18(3) dated Aug. 28, 2019 in connection with United Kingdom Patent Application No. GB 1701547.0, 4 pages.

Combined Search and Examination Report under Section 17 & 18(3) dated Aug. 28, 2019 in connection with United Kingdom Patent Application No. GB 1902814.1, 5 pages.

Notification Concerning Transmittal of Copy of International Preliminary Report on Patentability dated Aug. 15, 2019 in connection with International Patent Application No. PCT/EP2018/052145, 10 pages.

International Search Report dated Nov. 5, 2018 in connection with International Patent Application No. PCT/EP2018/052145, 3 pages.

Written Opinion of the International Searching Authority dated Nov. 5, 2018 in connection with International Application No. PCT/EP2018/052145, 6 pages.

Examination Report under Section 18(3) dated Feb. 27, 2020 in connection with United Kingdom Patent Application No. GB 1701551.2, 2 pages.

* cited by examiner

THROW LOCK ASSEMBLY AND BOLT KEEPER ASSEMBLY

CROSS-REFERENCE TO RELATED APPLICATIONS

This application is a 371 of International Application No. PCT/EP2018/052152 filed on Jan. 29, 2018, which claims priority to United Kingdom Patent Application No. 1701551.2 filed on Jan. 31, 2017, the disclosures of which are herein incorporated by reference in their entirety.

TECHNICAL FIELD

This disclosure relates generally to lock assemblies for locking door or gates, to bolt keepers for receiving throw bolts, and to sheaths for the bolt keepers.

BACKGROUND

Long throw lock systems can be installed onto gate- and doorways. There is a need for lock systems that can reduce the risk of damage to the door panels, gates, door frames or gate posts by operation of the lock system, particularly by not exclusively where these comprise relatively expensive wood materials. There is also a need for lock systems that generate relatively little noise when the gateway is disturbed by wind or other incidental forces.

SUMMARY

According to a first aspect, there is provided a throw lock assembly (which may be referred to herein simply as a 'lock assembly') for locking a gateway, comprising a throw bolt, a bolt holder and a bolt keeper; configured such that when arranged as in use (in which the holt holder and the bolt keeper may be attached to respective gateway members, such as a door panel and door frame, or a gate and gateway), the throw bolt will be moveably coupled to the bolt holder (in other words, held by the bolt holder such that the throw bolt can be moved within, relative to or through the bolt holder), and the bolt keeper can receive the throw bolt (more specifically, a portion, or end portion, of the throw bolt) when the throw bolt is moved into a locking position; in which the bolt keeper comprises a buffer and a biasing mechanism, configured such that when the lock assembly is arranged as in use, and the throw bolt is in the locking position, the buffer will space the throw bolt apart from a surface to which the bolt keeper is attached; and the biasing mechanism will bear on the bolt and bias it against the buffer.

According to a second aspect, there is provided a bolt keeper assembly for a throw lock assembly comprising a throw bolt, comprising a bracket and a sheath, the sheath configured for receiving an end portion of a throw bolt, and the bracket and the sheath configured such that the sheath can be mounted within the bracket, the sheath disposed for receiving the end portion of the bolt when the throw lock assembly is arranged as in use; the sheath comprising a buffer and a biasing mechanism, configured such that when the throw bolt is received in the sheath in use, the buffer will space the throw bolt apart from a surface to which the bolt keeper is attached; and the biasing mechanism will bear on the bolt and bias it against the buffer.

According to a third aspect, there is provided a sheath for a bolt keeper for a throw lock assembly, in which the sheath is configured for receiving an end portion of a throw bolt, and the bracket and the sheath configured such that the sheath can be mounted within the bracket, the sheath disposed for receiving the end portion of the bolt when the throw lock assembly is arranged as in use; the sheath comprising a buffer and a biasing mechanism, configured such that when the throw bolt is received in the sheath in use, the buffer will space the throw bolt apart from a surface to which the bolt keeper is attached; and the biasing mechanism will bear on the bolt and bias it against the buffer.

Various configurations and arrangements of throw lock assemblies, bolt keepers and sheaths are envisaged by this disclosure, non-limiting, non-exhaustive examples of which are described in the paragraphs that follow.

In some example arrangements, the biasing mechanism may comprise a deflector member or boss, and may comprise or consist of resilient polymer material.

In some example arrangements, the buffer may comprise a plate, disc or pad, and may comprises or consist of resilient polymer material.

In some example arrangements, the bolt keeper may comprise a sheath configured for receiving the throw bolt, a side wall of the sheath forming the buffer; in other words, the buffer may comprise the side wall of a sheath; and in some example arrangements, the biasing mechanism may depend from an opposite side wall of the sheath.

In some example arrangements, in which the sheath may comprise a tubular body having a pair of opposite open ends, and a corresponding pair of flanges, each flange provided proximate a respective open end, configured for accommodating a trough portion of the bracket between the flanges.

In some example arrangements, the sheath may comprise a tubular body that will azimuthally enclose a received portion of the throw bolt.

In some example arrangements, the bolt keeper may comprise a bracket and a sheath, configured such that when arranged as in use (the bracket attached to a gateway member such as a door frame or gate post), the bracket will accommodate the sheath in a disposition for receiving the throw bolt. In some examples, the bolt keeper may be an assembly of a bracket and a sheath, the sheath comprising a plurality of side walls surrounding a cavity, configured for receiving the throw bolt through an open end of the cavity in use, and the bracket and the sheath configured such that when arranged as in use, the bracket will hold the sheath disposed for receiving the throw bolt; and the buffer comprises a side wall of the sheath, and the biasing mechanism comprises a deflectable tongue depending from an opposite side wall of the sheath into the cavity, extending at an incline away from the open end of the cavity.

In some example arrangements, the biasing mechanism comprises a tongue extending into the cavity at an angle of at least about 5 degrees or at least about 10 degrees, and/or at most about 45 degrees, or at most about 30 degrees, or at most about 20 degrees, or at most about 15 degree from a side wall of the sheath.

In some example arrangements, the sheath may comprise or consist of polymer material; and/or the bracket may comprise or consist of metal.

In some example arrangements, the bracket may define a trough, and the sheath can be inserted into the trough, and can be held by the bracket against a surface to which the bracket is attached.

In some example arrangements, the throw bolt assembly may comprise a bolt casing, a cutting barrier and a spacer member; the bolt casing being more corrosion-resistant than the cutting barrier, the cutting barrier being harder than the bolt casing and harder than the spacer member; configured such that when assembled as in use, the spacer member and the cutting barrier will be enclosed within the bolt casing, the cutting barrier extending over the intermediate length of the throw bolt; and the spacer member disposed between the cutting barrier and a side wall of the bolt casing, spacing the cutting barrier apart from the side wall.

In some example arrangements, the lock assembly may be configured such that when assembled as in use, the throw bolt will travel a throw distance of at least about 2.0 cm, at least about 3.0 cm, at least about 5.0 cm, or at least about 7.0 cm, and/or at most about 10 cm, when it is moved from a non-locking position.

In some examples, the bolt casing may define an external surface of the throw bolt and have a salt-spray (NSS) corrosion resistance of at least 1,000 hours, or at least 2,000 hours, according to the ISO9227™ standard. This may be advantageous if an example throw lock system were exposed to the outdoor environment in use (for example, exposed to rain, or to water containing salt). In some example arrangements, the bolt casing may comprise or consist of stainless steel, for example 304 or 316 stainless steel.

In some example arrangements, the cutting barrier may comprise or consist of material having Rockwell C hardness of at least about 55 HRc, at least about 60 HRc, or at least about 65 HRc. For example, the cutting barrier may comprise or consist of technical ceramic material (for example aluminium oxide, tungsten carbide), cemented carbide material, cast iron, polymer material, high-carbon steel, hardened steel, or nickel alloy material. The cutting barrier may be configured such that it can resist attack by means of a tool, in which the hardness of the blade, point, edge or bit of the tool may comprise or consist of steel, or other material having hardness of at least about 62HRc. For example, the tool may comprise a saw blade, drill bit, or a chisel edge. In some examples, the cutting barrier may resist being broken within 5, 10 or 15 minutes of continuous attack by a tool, for example a steel hacksaw blade.

In some example arrangements, the bolt casing may comprise or consist of a plurality of cooperatively configured casing members; and in some example arrangements, the bolt casing may comprise or consist of a sheath, sleeve, or jacket configured for accommodating at least the cutting barrier; or the bolt casing may comprise a casing body and a cover plate; configured such that the casing body defines a cavity for accommodating the cutting barrier, and the cover plate can be joined to the casing body to enclose the cutting barrier within the cavity.

In some example arrangements, the bolt casing may comprise or consist of a tube, configured for containing the cutting barrier within a cavity extending between opposite ends of the tube; or a bar provided with a recess in a side thereof, configured for accommodating the cutting barrier. For example, the bolt casing may comprise or consist of an elongate tube having a transverse cross-section that is generally square, rectangular, other polygonal, circular, or oval, or a shape including polygonal and arcurate portions. In some examples, the bolt casing may be in the general form of a tube including a cavity extending between opposite ends of the tube, one or both of which may be open or closed, at least when not fully assembled. The interior surface of the central cavity may be conformal and/or concentric with the external surface of the casing body. In some examples, the bolt casing may be in the general form of a bar or rod, having a recess or groove formed into a side thereof, for accommodating the cutting barrier.

In some example arrangements, the cutting barrier may comprise or consist of a rod or bar; in some examples, the cutting barrier may comprise or consist of a plurality of barrier members; for example, two or three barrier members, each of which may be in the form of a bar or rod.

In some example arrangements, the throw bolt may comprise a spacer member, the cutting barrier being harder than the spacer member; configured such that when assembled as in use, the spacer member will be enclosed within the bolt casing, and disposed between the cutting barrier and a side wall of the bolt casing, spacing the cutting barrier apart from the side wall. For example, the spacer member may have Rockwell C hardness of at most about 62 HRc, and/or at least 50 HRc. In some examples, the spacer member may comprise or consist of stainless steel, for example grade 201 stainless steel, aluminium, or zinc alloy material.

In some example arrangements, the spacer member may comprise material having higher hardness than the bolt casing. For example, the spacer member may comprise stainless steel, or zinc alloy material.

In some example arrangements, the spacer member may be accommodated adjacent at least a portion of the bolt casing. For example, the spacer member may be elongate, and the sheath and spacer member may be configured such that when assembled, the spacer member will lie along at least a part of the length of the bolt casing, adjacent or abutting an internal side of the cavity of the bolt casing. In such examples, a recess or blind hole can be formed into the spacer member (through the sheath), without material being remove from the cutting barrier.

In some example arrangements, the spacer member may have a thickness from a boundary with the side wall, such that a blind hole can be bored through the side wall and to a depth into the spacer member, the depth being less than the thickness, and sufficiently great to accommodate a tooth of a locking mechanism with sufficient purchase for the locking mechanism to drive the throw bolt between the non-locking and locking positions.

In some example arrangements, the throw bolt may be provided with an array or a row of recesses or blind holes, formed into a side of the bolt, through the bolt casing. In some examples, the hole or holes may be formed into the cutting barrier, and/or into the spacer member. The recesses or holes may be configured and arranged to accommodate members of a locking/unlocking mechanism (for example a key mechanism) for engaging and moving the bolt. For example, the recesses or holes may be configured and arranged for engagement by teeth of a key mechanism. The recesses or holes may be formed to a high dimensional accuracy, to achieve a smooth locking and unlocking action.

In some example arrangements, the spacer member may comprise or consist of a bar having with a recess configured to accommodate the cutting barrier.

In some example arrangements, the bolt casing may define an elongate cavity, and the cutting barrier and spacer member may comprise respective elongate bodies; configured such that the bolt casing and the cutting barrier can be disposed within the cavity, extending between opposite ends of the cavity.

In some example arrangements, the cutting barrier and/or the spacer member may be the form of respective square or rectangular prisms, one or both of which may be configured to extend substantially the entire length of the cavity defined by the bolt casing; or substantially the entire length of the bolt casing, apart from end caps if these are present; in other words, the barrier member and/or the spacer member may connect opposite ends of the bolt casing.

According to a third aspect, a method of assembling a lock assembly is provided, the method including assembling the bolt, and using a tool to remove material from at least the bolt casing, to accommodate a mechanism for engaging and moving the bolt in use. The method may include boring through the side wall of the bolt casing and into the spacer member, forming a blind hole in the spacer member, the depth of the blind hole being less than the thickness of the spacer member. In some examples, the method may including boring a plurality of blind holes into the throw bolt, arranged in a linear row.

A method of using a lock assembly can be provided, the method including attaching the lock assembly (in assembled form) to a door- or gateway (for example, attaching a part of the lock assembly to a door leaf or panel, or a gate, and a part to a doorway casing or frame, or to a wall, or to a gate post), such that the lock will be exposed to outdoor environment in use, including for example to rain and wind.

Some disclosed example lock assemblies, bolt keepers and sheaths may have the aspect of reducing the risk of the throw bolt damaging the surface of the gateway in the course of use, since the buffer will space an end portion of the throw bolt apart from the surface when the throw bolt is in the locking position. In some examples, the clamping force applied to the throw bolt by the biasing member may be sufficient to resist movement of the throw bolt within the bolt keeper, which might tend to arise from wind or other incidental forces acting on the gate or door. Consequently, the bolt keeper may have the aspect of reducing or substantially preventing the throw bolt from rattling within it.

BRIEF DESCRIPTION OF THE DRAWINGS

Example arrangements of lock assemblies will be described in more detail with reference to the accompanying drawings, of which:

FIG. 4B shows a longitudinal (upper) and top view (lower) of an example sheath for a bolt keeper.

DETAILED DESCRIPTION

Figure 1A:
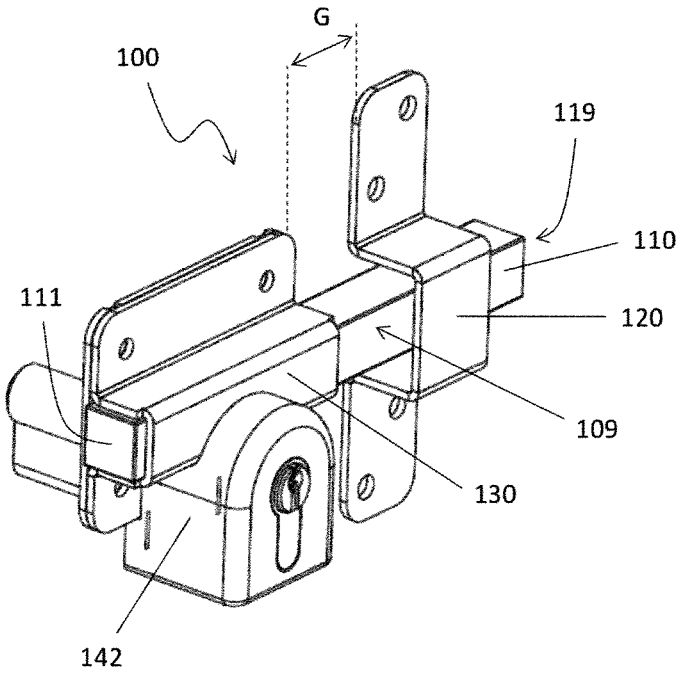
FIG. 1A shows a schematic perspective view of an example lock assembly.

With reference to FIG. 1A to FIG. 4B, example throw lock assemblies 100 for locking a gateway 200, 200A, 200B comprise a throw bolt 110, a bolt holder 130 and a bolt keeper 120. The bolt keeper 120 may comprise a metal bracket 122 for receiving an end portion of the throw bolt 110. The bolt holder 130 houses the throw bolt 110, such that the throw bolt 110 can slide within the bolt holder 130 between non-locking and locking positions. The bolt housing 130 and bracket 120, 122 may comprise plates provided with screw-holes 152 (FIG. 2A), through which screws 150 (FIG. 3A) can be driven to attach the bolt housing 130 and bracket 120, 122 to respective gateway members 200A, 200B (shown in FIG. 2A). For example, the bolt holder 130 may be attached to a door panel or a gate, and the bolt keeper 120 may be attached to a corresponding door frame, gate post or wall; or the bolt keeper 120 may be attached to a door panel or a gate, and the bolt holder 130 may be attached to a corresponding door frame, gate post or wall. FIG. 2B shows a transverse cross-section view of the example throw lock assembly 100 mounted onto the gateway member 200A, the view being from the proximal end 111. The throw lock assembly may have a long throw, in which the throw bolt will travel a throw distance of about 75 mm between the non-locking position and locking positions.

The throw bolt 110 may have the external form of an elongate square rectangular bar having proximal and distal ends 110A, 110B, the end portion of the throw bolt 110 being adjacent the distal end 119. Substantially the whole (external) surface of the throw bolt 110 may comprise stainless steel for good corrosion resistance, which may be particularly—but not exclusively—relevant where a throw lock assembly 100 is used on an outdoor gateway. The throw lock assembly 100 may also comprise a single or double locking cylinder 140 and cylinder cover 142 for a key mechanism to move the throw bolt 110 in use, between the non-locking and locking positions. The throw lock assembly may comprise other components, such as an escutcheon and lock base.

Figure 1B:
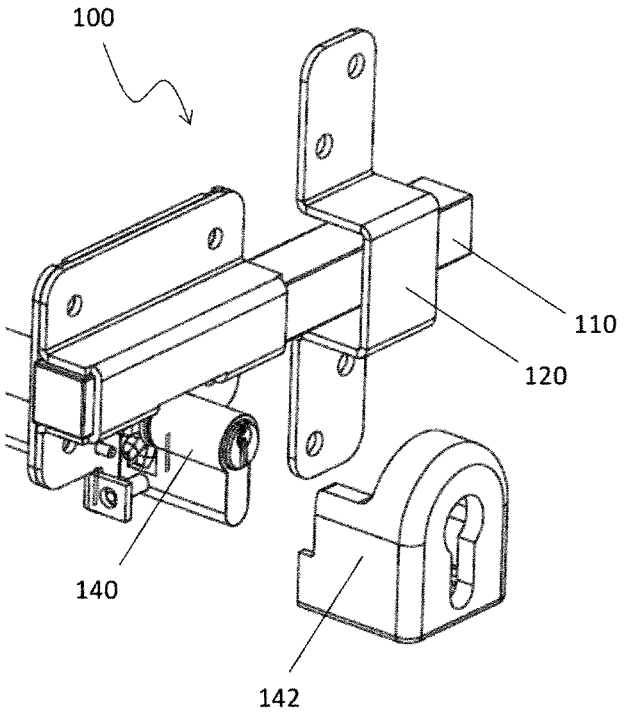
FIG. 1B shows a partially exploded perspective view of the example lock assembly.
Figure 2A:
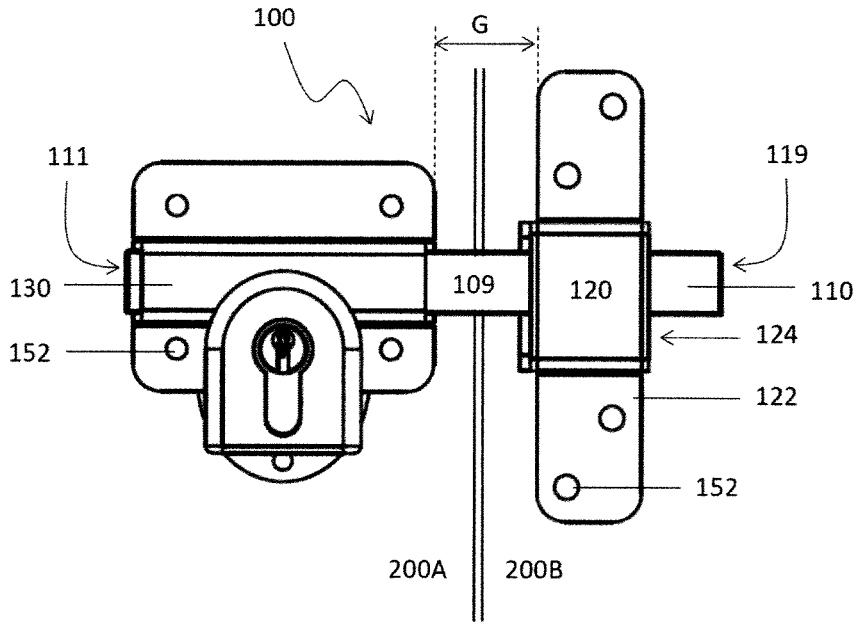
FIG. 2A shows a schematic front view of an example lock assembly attached to a schematic gateway.
Figure 2B:
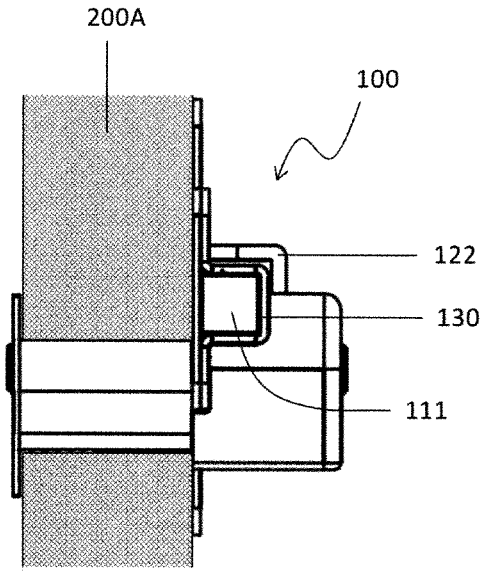
FIG. 2B shows a partially a transverse cross-section through a part of the example lock assembly and a part of the gateway.

When the throw bolt assembly 100 is installed on a gateway 200A, 200B, the throw bolt 110 can slide within the bolt holder 130, in response to rotation of a gear wheel mounted in the locking cylinder 140 and driven by the action a key mechanism. The gear wheel may have a plurality of teeth arranged radially around its circumference, and the throw bolt 110 may have corresponding recesses provided in an under-side of the throw bolt 110, arranged in a row and shaped to receive the teeth with sufficient purchase for the teeth to engage and drive the throw bolt 110 between the non-locking and locking positions in use. When the throw bolt 110 is in the non-locking position, it will be maximally retracted from the bolt keeper 120 to allow the gateway to open, and when it is in the locking position (as shown in FIGS. 1A, 1B and 2A), the throw bolt 110 will maximally project from the bolt holder 130, its end portion being inserted into the bolt keeper 120.

When the throw lock assembly 100 is installed on a gateway for use, and throw bolt 110 is in the locking position, an intermediate length 109 of the throw bolt 110 will extend over a gap length G from an end (fore-end) of the bolt holder 130 to the nearest end of bolt keeper 120, across a spacing between the respective gateway members 200A, 200B. In this position, the throw bolt 110 will interlock the bolt holder 130 and the bolt keeper 120, thus locking the gateway. The intermediate length 109 will be a portion of the throw bolt 110 that may be accessible to an intruder attempting to break in through the gateway, and may be a target for a break in attack. For example, an intruder may attempt to break in by sawing (or cutting or boring) through the intermediate portion 109 of the throw bolt 110, by means of a tool having a steel blade, tip or bit, which may operate by causing abrasive wear of the throw bolt 110.

Figure 3A:
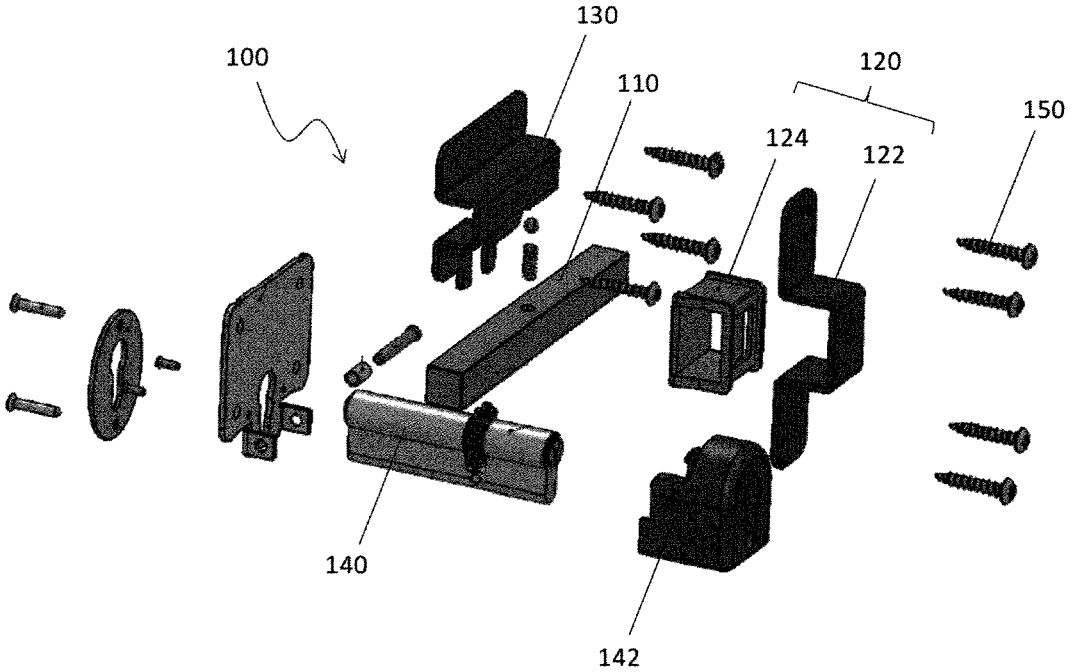
FIG. 3A shows an exploded view of an example lock assembly.
Figure 3B:
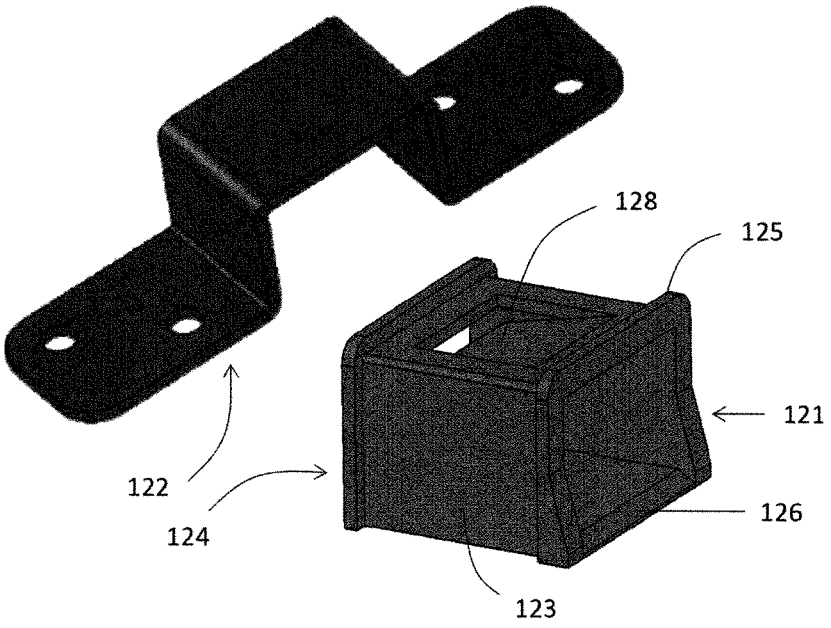
FIG. 3B shows an exploded schematic view of a bracket and an example sheath of an example bolt keeper.
Figure 3C:
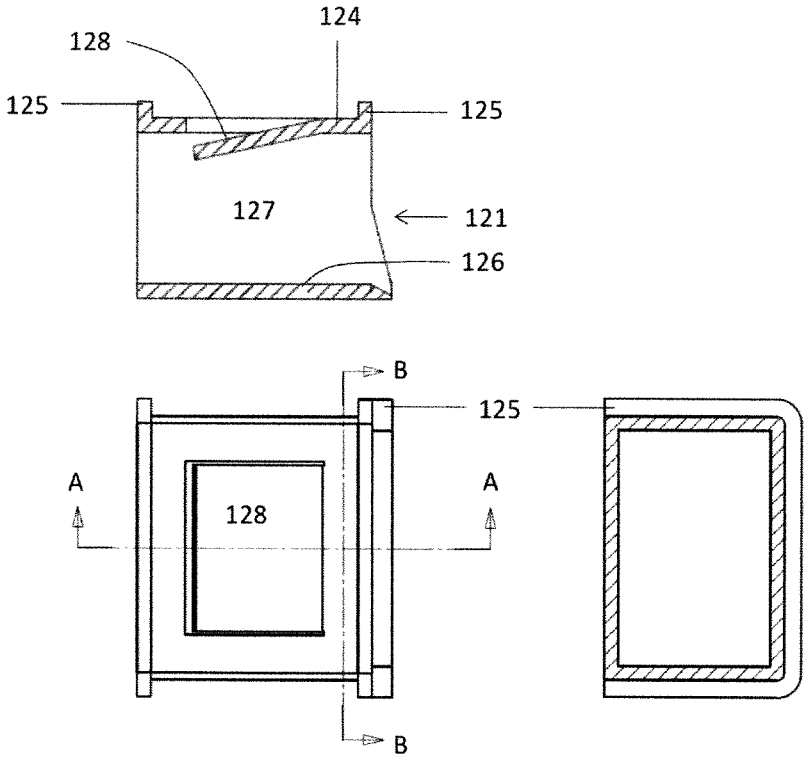
FIG. 3C shows a top view of the example heath, as well as cross-section views of the sheath on the planes A-A and B-B; and FIG. 4A
Figure 4A:
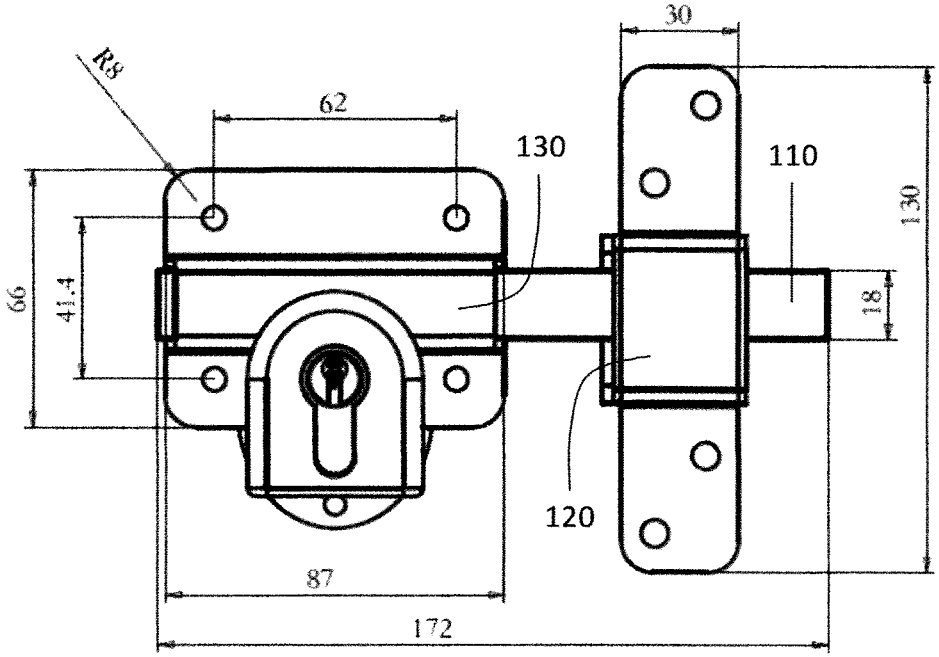
FIG. 4A shows a front view of the locking assembly, arranged as installed on a gateway and in the locking position.
Figure 4B:
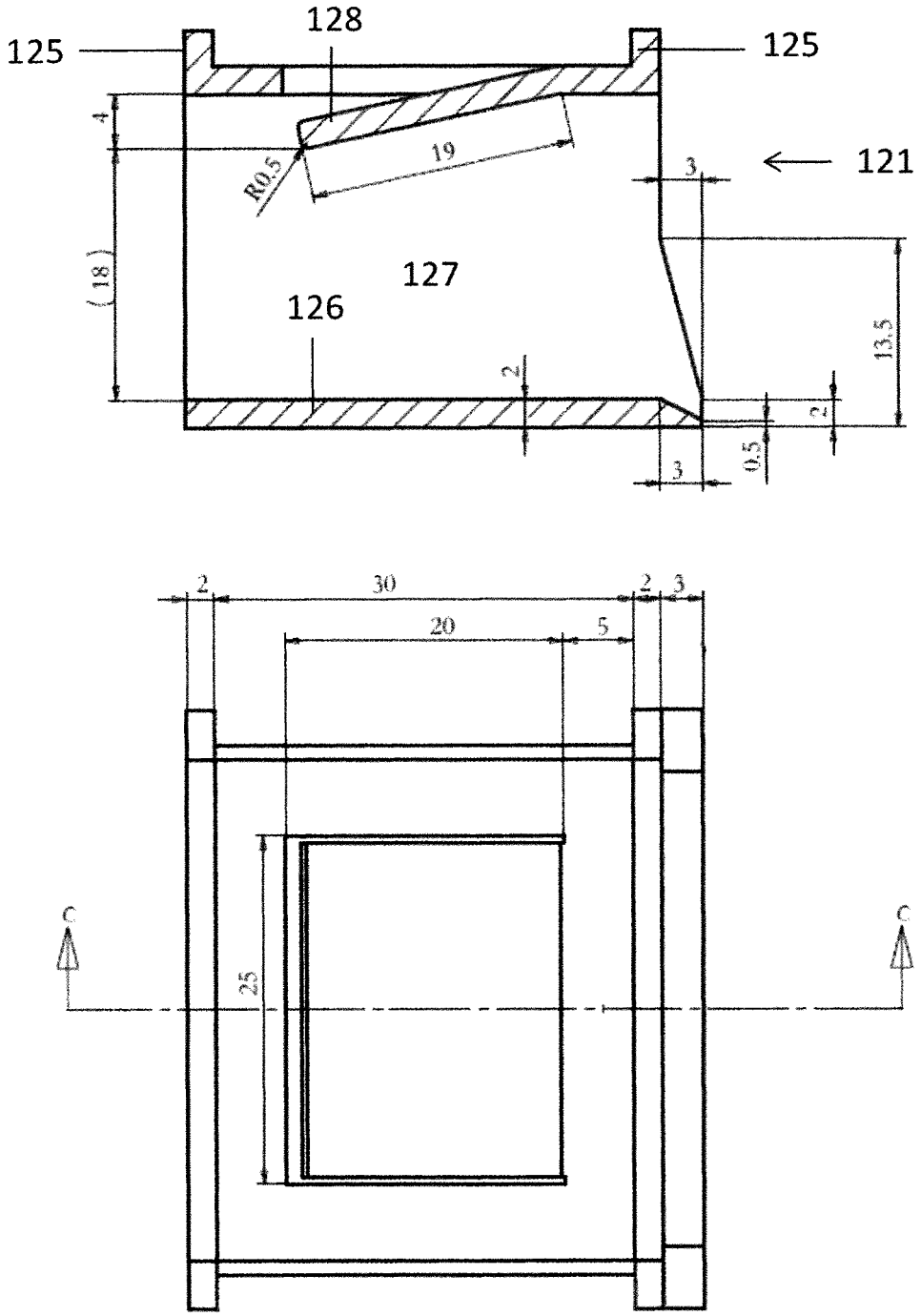
FIG. 4B shows views of certain parts of an example throw lock assembly, including dimensions in units of millimetres and degrees; in particular.

The bolt keeper 120 may comprise a metal bracket 122 and a plastic sheath 124, in which the sheath 124 is fitted within the bracket 122 and is configured for receiving the end portion of the throw bolt 110. With reference to FIG. 3B, an example sheath 124 may be provided as a separate member, which can be inserted into the bracket 122 and mounted against a gateway member by means of the bracket 122. In the example shown, the sheath 124 may comprise a tubular body 123 having a cavity extending between proximal and distal ends, the proximal end 121 being configured for receiving the end portion of the throw bolt 110 in use. The example sheath may comprise respective flanges 125 provided at each open end, configured such that the bracket 122 will fit between the flanges 125 and the flanges will resist or prevent the sheath 124 from being extracted from the bracket 122.

In the particular example shown, the tubular body 123 of the sheath 124 comprises four side walls, arranged to define a substantially square rectangular cavity 127 corresponding to the shape and dimensions of the throw bolt 110. In some examples, the sheath 124 may be formed by a method including extrusion and/or moulding of plastic material. One of the side walls 126 will be positioned against the gateway member 200B (or 200A) when installed for use, and provide a buffer that will space the end portion of the throw bolt 110 apart from the gateway member 200B when the throw bolt is in the locking position. The tubular member 123 may comprise a tongue 128 depending from an opposite side wall at an angle of about 10 to 15 degrees. The tongue 128 extends away from the proximal end 121, such that when the throw bolt 110 is inserted into the sheath 124, it will urge the tongue 128 to deflect towards the side wall from which it depends, the tongue 128 providing some resistance to the insertion of the throw bolt 110. In this example, the tongue is formed as an integral part of the tubular member 123 and consists of the same resilient plastic material, and is disposed so that it will allow the throw bolt 110 to be inserted into the cavity, and once the throw bolt 110 has been fully inserted (in the locking position) the tongue 128 will bear on the throw bolt 110 and urge it against the buffer side wall 126. The clamping force applied to the throw bolt 110 by the tongue 128 may be sufficient to resist movement of the throw bolt 110 within the bolt keeper 120, which might tend to arise from wind or other incidental forces acting on the gateway members 200A, 200B. Consequently, the bolt keeper 120 may have the aspect of reducing or substantially preventing the throw bolt 110 from rattling within it. In this example, the buffer side wall 126 of the sheath 120 is also formed as an integral part of the tubular body 123, and also consists of the same resilient plastic material as the rest of the sheath 120. It may provide the additional aspect of preventing, or at least reducing the risk of the throw bolt 110 from scratching the surface of the gateway member 200B (200A) as it is moved between the non-locking and locking positions in use. This may be especially relevant when the gateway member 200B (200A) comprises high quality, relatively costly wood or other material that is softer that stainless steel.

As used herein, 'gateway' and 'doorway' may be used interchangeably, and may refer to indoor or outdoor access systems for buildings, gardens, driveways or real estate generally. A gateway may comprise a moveable barrier that can be arranged to prevent or enable access through a fixed barrier, such as a wall, fence, or hedge. The moveable barrier may comprise or consist of door, gate, panel, leaf, stile or rail, for example, an edge of which may be attached to the fixed barrier, a frame, door casing, or gate post, for example, by means of a sliding or hinge mechanism. A lock assembly may be installed on the gateway to prevent or resist the moveable barrier from being moved relative to the fixed barrier, thus locking the door or gate.

The invention claimed is:

1. A throw lock assembly to lock a gateway, the throw lock assembly comprising:

a throw bolt;

a bolt holder; and a bolt keeper, the throw lock assembly configured such that:

the throw bolt is moveably coupled to the bolt holder; and the bolt keeper receives the throw bolt when the throw bolt is moved into a locking position;

the bolt keeper comprising a buffer and a deflectable tongue, configured such that when the throw bolt is in the locking position:

the buffer spaces the throw bolt apart from a surface to which the bolt keeper is attached; and the deflectable tongue bears on the throw bolt and biases it against the buffer;

wherein the bolt keeper is an assembly of a bracket and a sheath, the sheath comprising a tubular body having a plurality of side walls surrounding a cavity, configured to receive the throw bolt through an open end of the cavity and enclose a received portion of the throw bolt, the bracket and the sheath configured such that the bracket holds the sheath disposed to receive the throw bolt; and the buffer comprising a first side wall of the sheath, wherein the deflectable tongue depends from a second side wall of the sheath, the second side wall opposing the first side wall, the deflectable tongue extending into the cavity at an angle so that a free end of the deflectable tongue faces away from the open end of the cavity.

2. The throw lock assembly as claimed in claim 1, in which the deflectable tongue comprises a deflector member or boss.

3. The throw lock assembly as claimed in claim 1, in which the buffer comprises resilient polymer material.

4. The throw lock assembly as claimed in claim 1, the sheath comprising resilient polymer material.

5. A bolt keeper assembly of a throw lock assembly comprising a throw bolt, the bolt keeper assembly comprising:

a bracket; and a sheath, the sheath configured to receive an end portion of the throw bolt, and the bracket and the sheath configured such that the sheath is mounted within the bracket, the sheath disposed to receive the end portion of the throw bolt;

the sheath comprising a buffer and a deflectable tongue, configured such that, when the throw bolt is received in the sheath:

the buffer spaces the throw bolt apart from a surface to which the bolt keeper assembly is attached; and the deflectable tongue bears on the throw bolt and biases it against the buffer;

the sheath comprising a tubular body having a plurality of side walls surrounding a cavity, configured to receive the throw bolt through an open end of the cavity and enclose a received portion of the throw bolt, the bracket and the sheath configured such that the bracket holds the sheath disposed to receive the throw bolt; and the buffer compises comprising a first side wall of the sheath, wherein the deflectable tongue depends from a second side wall of the sheath, the second side wall opposing the first side wall, the deflectable tongue extending into the cavity at an angle so that a free end of the deflectable tongue faces away from the open end of the cavity.

6. The bolt keeper assembly as claimed in claim 5, in which the sheath comprises resilient polymer material.

7. The bolt keeper assembly as claimed in claim 5, in which the tubular body of the sheath has a pair of opposite open ends and a corresponding pair of flanges, each flange provided proximate a respective open end, configured to accommodate part of the bracket between the flanges.

8. A sheath of a bolt keeper assembly as claimed in claim 5, the sheath comprising:

a plurality of side walls surrounding a cavity, configured to receive a throw bolt through an open end of the cavity;

a buffer comprising a first side wall of the sheath; and a deflectable tongue depending from a second side wall of the sheath, the second side wall opposing the first side wall, the deflectable tongue extending into the cavity at an angle of 5 to 45 degrees from the second side wall of the sheath and so that a free end of the deflectable tongue faces away from the open end of the cavity.

9. The sheath as claimed in claim 8, in which the deflectable tongue comprises a deflector member or boss.

10. The sheath as claimed in claim 8, further comprising a tubular body having a pair of opposite open ends, and a corresponding pair of flanges, each flange provided proximate a respective open end, configured to accommodate part of a bracket between the flanges.

11. The sheath as claimed in claim 8, in which the sheath comprises resilient polymer material.

* * * * *